US005159052A

United States Patent [19]

Barthelemy et al.

[11] Patent Number: 5,159,052

[45] Date of Patent: * Oct. 27, 1992

[54] POLYAMIDE-IMIDE BASED FILAMENTS, AND A PROCESS FOR OBTAINING THEM

[75] Inventors: Pascal Barthelemy; Bruno Testard, both of Lyons, France

[73] Assignee: Rhone Poulenc Fibres, Lyons, France

[ * ] Notice: The portion of the term of this patent subsequent to Aug. 21, 2007 has been disclaimed.

[21] Appl. No.: 790,163

[22] Filed: Nov. 12, 1991

Related U.S. Application Data

[63] Continuation-in-part of Ser. No. 408,526, Sep. 18, 1989, abandoned.

[30] Foreign Application Priority Data

Sep. 21, 1988 [FR] France ..... 88 12560

[51] Int. Cl.[5] ..... C08G 73/14

[52] U.S. Cl. ..... 528/73

[58] Field of Search ..... 528/73

[56] References Cited

U.S. PATENT DOCUMENTS

| | | | |
|---|---|---|---|
| 3,843,587 | 10/1974 | Keating | 528/73 |
| 4,061,623 | 10/1976 | Onder | 528/73 |
| 4,950,700 | 8/1990 | Balme et al. | 524/111 |

FOREIGN PATENT DOCUMENTS

| | | |
|---|---|---|
| 2079785 | 11/1971 | France . |
| 2149020 | 3/1973 | France . |
| 2354187 | 1/1978 | France . |

*Primary Examiner*—Maurice J. Welsh
*Assistant Examiner*—Rachel Johnson
*Attorney, Agent, or Firm*—Stevens, Davis, Miller & Mosher

[57] ABSTRACT

The present invention relates to heat-resistant threads, filaments and fibres based on polyamide-imide. They have a polydispersion index $I \leqq 2.2$, a breaking tenacity $\geqq 45$ cN/tex, a Young's modulus $\geqq 3.8$ GPa, an elongation $\leqq 25\%$ and a color defined by the luminance $Y > 25\%$, the degree of whiteness $DW < 30$ and the yellow index $YI > 170$. In addition they have a very good stability to light, quantified by the retention of the mechanical characteristics. They have wide application in working and protective garments.

13 Claims, No Drawings

POLYAMIDE-IMIDE BASED FILAMENTS, AND A PROCESS FOR OBTAINING THEM

This application is a continuation-in-part of our prior copending application Ser. No. 07/408,526, filed Sep. 18, 1989, now abandoned.

The present invention relates to polyamide-imide based thermostable synthetic filaments with improved properties.

It also relates to a process for obtaining such filaments.

It is already known, according to FR 2,079,785 to prepare glossy polyamide-imide based filaments, containing at least 3% of alkali or alkaline earth 3,5-dicarboxybenzene sulphonate chains, by wet spinning of a polymer solution in N-methylpyrrolidone, in a coagulating aqueous bath also containing N-methylpyrrolidone, and then drawing, washing and drying.

But such filaments have mechanical characteristics which are too weak for certain applications, a yellow-brown colour which is too great, and show thermal degradation and a poor resistance to photodegradation.

The polyamide-imide filaments according to the present invention have characteristics which are clearly superior to those of the polyamide-imide filaments of the prior art. They have the following chemical structure:

amide-imide units (A) of formula

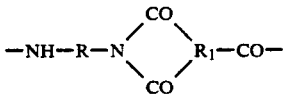

amide units (B) of formula

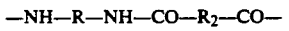

and optionally amide units (C) of formula

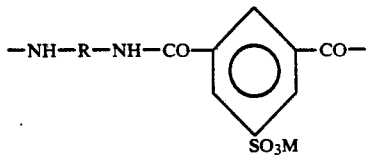

in which R represents a divalent aromatic radical, $R_1$ represents a trivalent aromatic radical, $R_2$ represents a divalent aromatic radical and M an alkali metal or alkaline earth metal, A units representing 80 to 99% of the whole of the units, B units representing 1 to 5% of the whole of the units and C units representing 0 to 20% of the whole of the units.

The filaments according to the invention are also characterized by a polydispersion index $I \leqq 2.2$, a tenacity $\geqq 45$ cN/tex, a Young's modulus $\geqq 3.8$ GPa, an elongation $\leqq 25\%$ and a colour defined by the luminance $Y > 25\%$, the degree of whiteness $DW < 30$ and the yellow index $YI > 170$.

Preferably, the tenacity is of the order of 50 to 55 cN/tex, the modulus $\geqq 4$ GPa, the luminance $Y > 30\%$, the degree of whiteness $< 28$, and the yellow index $> 190$.

The light stability of the PAI according to the invention is also very much improved with respect to those of the PAI filaments known up to now. It is evaluated by the retention of mechanical properties, breaking tenacity $\geqq 50\%$, work to breaking 18% and elongation $\geqq 35\%$. The light stability is measured according to the method described below.

According to the present invention, by polyamideimide (PAI) is understood the polymers obtained by polycondensation in any appropriate solvent of:

at least one diisocyanate of formula: OCN-R-NCO in which R is a divalent aromatic group such as 4,4-diphenylmethane diisocyanate, and preferably 4,4'-diphenylether diisocyanate or their mixtures, with:

an aromatic acid anhydride such as benzene-1,2,4-tricarboxylic acid anhydride, an aromatic dicarboxylic acid such as terephthalic acid, and optionally an alkali metal or alkaline earth metal dicarboxybenzene sulphonate, preferably sodium or potassium dicarboxybenzene sulphonate.

The filaments according to the invention have a chemical structure such as defined above in which R is a radical such as

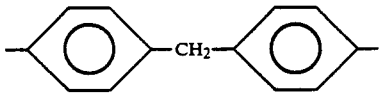

and preferably

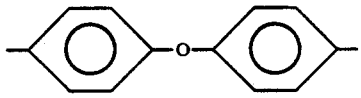

and $R_1$ is preferably a

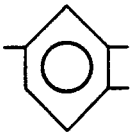

radical $R_2$ is preferably a

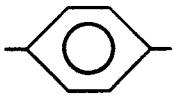

radical and M is preferably Na or K.

According to the present application the PAI filaments are also characterized by a value of the polydispersion index $I \leqq 2.2$. This index corresponds to the ratio $\overline{Mw}/\overline{Mn}$, the values of $\overline{Mn}$ and $\overline{Mw}$ being determined by gel permeation chromatography (GPC) in NMP at 80° C. and 0.1 mole/liter of lithium bromide, the masses being expressed with respect to a polystyrene standard.

The polydispersion index of the PAI filaments according to the invention remains low: it corresponds to a tight distribution of the molecular masses. Surprisingly, it remains low in the finished filaments in spite of the different treatments undergone by the threads during their manufacture.

Surprisingly, filaments according to the invention also have excellent mechanical and thermal characteristics which are much superior to those of the polyamide-imide filaments according to FR 2,079,785. In particular the tenacity is greater than or equal to 45 cN/tex, preferably greater than or equal to 50 or 55 cN/tex. Measurement is carried out with a manual or automatic dynamometer with a constant elongation gradient, on a filament sample which is subjected to longitudinal traction until it breaks. The dynamometer is linked to a calculator which provides the numerical values of the titre (dtex) of the breaking force (cN) and of the breaking tenacity=

$$\frac{\text{Breaking force } (cN)}{\text{Initial titre } (tex)}$$

and of the elongation to breaking %. The values correspond to a mean of 20 measurements.

Elongation to breaking is measured as indicated above. It is less than or equal to 25%.

The longitudinal Young's modulus E of the PAI filaments according to the invention is≧3.8 GPa, preferably≧a 4 GPa. It is the ratio:

$$E = \frac{\text{Specific force}}{\text{Corresponding unitary } \frac{\Delta_l}{l_0}}$$

obtained initially from the force/elongation curve. The specific force (tenacity) corresponds to the ratio:

$$\frac{\text{Force } (cN)}{\text{Initial titre } (tex)}$$

l being the length of the sample at time t, which corresponds to the true titre, and $l_o$ the initial length of the sample.

The PAI filament is, according to the invention, also characterized by a low surface colour, which is evaluated by three essential values:

the luminance Y %>25%, preferably>30% the degree of whiteness DW<30, preferably<28 the yellow index YI>170, preferably>190, measured in the following manner:

the sample is ground in a coffee mill so as to obtain a flock a few millimeters thick and 4 $cm^2$. The flock is placed between 2 glass plates, and the whole is placed in an "Elrepho" brand apparatus (Zeiss). The following results are obtained:

Y%: the luminance, which classifies the sample in the grey scale, and which translates the impression of light and dark:

Y%=100 corresponds to a perfect white

Y%=0 corresponds to a perfect black.

The degree of whiteness defines a colour point on the chromaticity map.

The Yellow index is an expression of the colorimetric purity in the yellow.

The PAI filaments according to the invention also have a good light stability, measured by exposure in severe aging conditions and quantified by:

a retention of breaking tenacity≧50%, preferably≧52%.

a retention of work to breaking≧18%, preferably≧20%.

a retention cf elongation≧35%, preferably 38%.

The measurements of light stability are carried out in an enclosure which allows the photoaging of the polymers to be studied experimentally in a dry atmosphere. The samples under test are arranged on a cylindrical tower which is driven by a circular rotatory movement and is situated at the centre of a parallelopipedal enclosure, the four corners of which are occupied by a "medium pressure" mercury vapour lamp type Mazda MA, 400 Watts. The envelope of the bulb only allows radiation greater than 300 nm (solar spectrum) to pass through. The temperature in the enclosure is 60° C.

Method: The 1.4 cm paper window on which the sample is fixed during the determination of the mechanical properties on an Instron is itself placed on one of the 24 supports of the tower in the chamber. After exposure, the paper window is recovered and the mechanical characteristics of the monofilament are determined according to the method indicated above for the determination of the mechanical properties.

The results are presented in the form of curves giving the percentage of the mechanical characteristics remaining in an exposed fibre, compared with a nonexposed one, as a function of the length of exposure. The values obtained depend on the starting monomers, the best results being obtained with 4,4'-diphenylether diisocyanate.

Comparisons have also been made with PAI filaments according to FR 2,079,785.

The filaments according to the invention are clearly superior to the known PAI filaments.

The filaments according to the invention also have a much better thermal stability than the known PAI filaments: this is evaluated by the degradation speed corresponding to a percentage loss of weight as a function of the time at a temperature of 375° in air.

Constant temperature degradation of PAI filaments according to the invention is generally≦3% per hour, and preferably≦2% per hour.

The level of this degradation also depends on the starting monomers, the best results being obtained with 4,4'-diphenylether diisocyanate.

The threads, filaments and fibres according to the present invention can be used alone, or mixed with natural or synthetic filaments or fibres with the object of modifying or improving certain properties. They are particularly useful for the manufacture of working and protective garments, by virtue of their mechanical properties and their thermal and light-resistance. In addition the filaments obtained are easy to dye to any colour with basic dyes.

The PAI filaments according to the present invention are obtained by wet spinning from polymer solutions in a solvent or solvent mixture. The concentration of the spinning solutions is between 4 and 35% by weight, preferably between 5 and 35%. The polymers are dissolved in a solvent or solvent mixture containing from 5 to 100% by weight of dimethylene urea of pH≦7, and 0 to 55% of an anhydrous aprotic polar solvent such as N-methylpyrrolidone, dimethylacetamide, dimethylformamide, tetramethylurea or γ-butyrolactone.

The solutions which are capable of being used in the process according to the invention should have a viscosity of between 100 and 200 poises, preferably between 150 and 160 poises. They can also contain various adjuvants such as pigments or roughening agents, to improve certain properties.

The PAI solutions ar spun in a binary or ternary aqueous coagulating bath containing a solvent or a solvent mixture in a proportion of 30 to 80% solvent and 20 to 70% water, preferably 40 to 70% solvent(s).

The solvent used can be dimethylformamide, dimethylethylene urea or a mixture of them. The spinning bath is maintained at between 15° and 40° C., preferably 20° to 30° C. The length of the coagulating bath is adaptable, generally as a function of the solvent concentration and the temperature. Baths having a higher solvent content generally allow filaments with better drawability properties, and therefore better final properties, to be obtained. However, when the solvent concentration is higher, a greater length of bath is necessary. The threads which come out of the coagulating bath in the state of a gel are then drawn, for example in the air, at a rate defined by the ratio $V2/V1 \times 100$, V2 being the speed of the drawing rolls and V1 that of the delivery rolls. The drawing rate of the filaments in the gel state is at least 100%, preferably at least 110% or even more.

After drawing the threads are washed by known methods in order to remove the solvent or solvents. This washing can be carried out, for example, in successive vats in which water circulates in countercurrent, or on washing rolls, or by any other means, preferably at ambient temperature.

The washed threads are then dried by known methods, for example in a dryer or on rolls. The temperature of this drying can vary within wide limits, as can the speed, which is greater as the temperature is higher. It is generally advantageous to carry out drying with progressive temperature elevation, this temperature being capable of attaining, and even passing, 200° C., for example.

The threads then undergo hot overdrawing to improve their mechanical qualities, and in particular their tenacity, which can be advantageous for certain uses.

This hot overdrawing can be carried out by any known method: stove, plate, roll or roll and plate, preferably within an enclosure. It must be carried out at a temperature of at least 150° C., which can attain, and even pass, 200° to 300° C. The overdrawing rate is generally at least 150%, but it can vary within wide limits according to the qualities required for the finished filament. The total drawing rate is at least 250%, preferably at least 260%.

The whole drawing and overdrawing process can be carried out in one or several stages, either continuously or discontinuously with the preceding operations. In addition the secondary drawing can be combined with drying. For this it is sufficient to provide, at the end of the drying stage, a zone of higher temperature which allows overdrawing.

EXAMPLES 1 TO 3

A PAI solution is prepared from:

| | |
|---|---|
| benzene-1,2,4-tricarboxylic acid anhydride (ANTM) | 40 mol % |
| terephthalic acid (AT) | 8 mol % |
| sodium salt of 5-sulphoisophthalic acid (AISNa) | 2 mol % |
| 4,4'-diphenylether diisocyanate (DIDE) | 50 mol % |

in dimethylethylene urea of pH≦7, so as to obtain a concentration of 21%; the polydispersion index of the polymer is 1.78.

The solution, with a viscosity of 598 poises, is extruded into an aqueous coagulating bath containing dimethylethylene urea. The threads come out of the coagulating bath in the gel state, and are drawn in the air at normal temperature. They are washed with water in a bath to remove the solvent, and dried on rolls.

The washed and dried threads undergo overdrawing in a stove maintained at a high temperature and then wound on cops. The precise process conditions are collated in Table 1 below:

TABLE 1

| | | Example 1 | Example 2 |
|---|---|---|---|
| coagulating bath | temperature °C. | 24 | 24 |
| | proportion DMEU/water (W/W) | 70/30 | 70/30 |
| | time(s) | 4.5 | 4.5 |
| air drawing: rate % | | 169 | 169 |
| washing (time is s) | | 5.5 | 5.5 |
| drying (°C.) | | 170 | 170 |
| overdrawing | rate % | 170 | 170 |
| | temperature °C. | 270 | 320 |

The mechanical properties of the filaments, obtained from the traction experiments, are collated in Table 2 which follows, where they are compared with filaments obtained from a solution of PAI in N-methyl-pyrrolidone spun under the conditions of French Patent FR 2,079,785 filed on Dec. 2, 1970 (Example 3C).

TABLE 2

| Ex. | Elongation % | Tenacity cN/tex | Modulus GPa | Temperature Tg °C. | Polydispersion index I |
|---|---|---|---|---|---|
| 1 | 21.2 | 45 | 6.2 | 254 | 2.05 |
| 2 | 17 | 46 | 6.4 | 265 | 2.05 |
| 3 C | 29 | 33 | 3.6 | 278 | 3 |

| Surface colour: | Ex. 1 | Ex. 2 | Ex. 3C |
|---|---|---|---|
| Luminance % | 31.1 | 33 | 21.8 |
| Degree of whiteness DW | 26.4 | 27 | 37.7 |
| Yellow index YI | 194 | 197 | 164 |

Light stability (after 40 hours of exposure in the enclosure)

| Retention: | Ex. 1 | Ex. 2 | Ex. 3C |
|---|---|---|---|
| breaking tenacity | 52% | 55% | 31% |
| work to breaking | 20% | 22% | 5% |
| elongation | 38% | 39% | 17% |

After exposure in the enclosure for only 20 hours, according to the method described above, the large and spectacular fall in the mass of the PAI polymer according to Example 3C is also noted: Mw goes from 147,120 to 62,950, that is a loss of 84,170. On the other hand, a polymer according to the invention clearly loses less:

Mw passes from 116,400 to 99,720, that is a loss of 16,680. In the same way, the polydispersion index of the polymer according to the invention after exposure passes from 2.05 to 2.13, while the polydispersion index of the polymer according to Example 3C passes from 3 to 4.12.

It is therefore noted that the fall in the mechanical properties expresses a greater degradation of the polymer chains in the filaments of Example 3C than in the filaments according to the invention.

Thermal Stability

Degradation kinetics, that is to say the loss of weight as a function of time represented by V in % $hours^{-1}$

| | 375° C. in air |
|---|---|

| | Ex. 1 | Ex. 2 | Ex. 3 |
|---|---|---|---|
| Speed of degradation % $h^{-1}$ | 2 | 1.9 | 6.8 |

EXAMPLE 4

A polymer which is identical to that described in Examples 1, 2 and 3, but which has a polydispersion index I=1.85 is prepared.

The solution of this polymer in DMEU has a concentration of 21% and a viscosity of 781 poises. It is spun under the following conditions:

| | | |
|---|---|---|
| coagulating bath | temperature °C. | 24 |
| | proportion DMEU/water | 60/40 |
| | time(s) | 6 |
| air drawing: rate % | | 167 |
| washing (time in s) | | 8 |
| drying (°C.) | | 200 |
| overdrawing | rate % | 180 |
| | temperature °C. | 260 |

The mechanical properties of the filaments are the following:

| Ex. | Elongation % | Tenacity cN/tex | Modulus GPa | Temperature Tg °C. | Polydispersion index I |
|---|---|---|---|---|---|
| 4 | 23 | 51 | 6.3 | 265 | 2.2 |

| Surface colour: | |
|---|---|
| Luminance Y % | 31 |
| Degree of whiteness DW | 25 |
| Yellow index YI | 196 |

| Light stability (after 40 hours of exposure in the enclosure) | | |
|---|---|---|
| Retention: | tenacity | 52% |
| | work to breaking | 20% |
| | elongation | 38% |

Polydispersion index: after 20 hours of exposure: 2.2
Thermal stability: Degradation kinetics (% $h^{-1}$): 2

EXAMPLES 5 to 7

A solution of PAI of the same chemical structure as that described in Example 1 is prepared in a mixture of DMEU/DMF in a proportion 72:28. The polymer obtained has a polydispersion index I=1.73 and the solution has a viscosity of 405 poises at a concentration of 21%.

It is extruded in an aqueous coagulating bath, then the threads are drawn and treated under the conditions collated in Table 3 which follows:

TABLE 3

| | | Example 5 | Example 6 | Example 7 |
|---|---|---|---|---|
| coagulating bath | temperature °C. | 20 | 20 | 20 |
| | concentration | DMF/water | DMEU/DMF/water | DMEU/DMF/water |
| | proportion | 40:60 | 21:9:70 | 13:27:60 |
| | time(s) | 4.5 | 4.5 | 4.5 |
| air drawing: rate % | | 167 | 145 | 167 |
| washing (time in s) | | 5.6 | 5.6 | 5.6 |
| drying (°C.) | | 160 | 160 | 160 |
| overdrawing | rate % | 180 | 180 | 180 |
| | temperature °C. | 300 | 300 | 300 |

The mechanical properties of the filaments obtained are collated in Table 4 which follows:

TABLE 4

| Ex. | Elongation % | Tenacity cN/tex | Modulus GPa | Polydispersion index I |
|---|---|---|---|---|
| 5 | 10.2 | 55.3 | 9.87 | 2.2 |
| 6 | 14.03 | 46 | 6.45 | 2.15 |
| 7 | 13 | 56.4 | 9.9 | 2.2 |

| Surface colour: | Ex. 5 | Ex. 6 | Ex. 7 |
|---|---|---|---|
| Luminance % | 30 | 31 | 31 |
| Degree of whiteness DW | 25 | 26 | 25.4 |
| Yellow index YI | 195 | 194 | 197 |

| Light stability: (after 40 hours of exposure) | | | | |
|---|---|---|---|---|
| Retention: | Ex. 5 | Ex. 6 | Ex. 7 | Nomex |
| breaking tenacity | 50% | 52% | 55% | 47% |
| work to breaking | 19% | 21% | 21% | — |
| elongation | 35% | 35% | 37% | 16% |
| modulus | 100% | 100% | 100% | 80% |

A polymetaphenylene isophthalamide fibre known commercially under the brand Nomex T 450 was subjected to the same photodegradation test as the fibres of the invention, for comparison. The retention of certain properties is indicated in the table below.

| Thermal stability | Ex. 5 | Ex.6 | Ex. 7 |
|---|---|---|---|
| Degradation speed % $h^{-1}$ | 2.1 | 1.9 | 1.8 |

We claim:

1. Heat-resistant synthetic polyamide-imide based threads, filaments and fibres, characterized in that they contain:

amide-imide units (A) of formula:

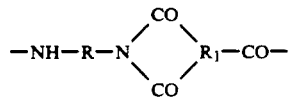

amide units (B) of formula:

$$-NH-R-NH-CO-R_2-CO$$

optionally amide units (C) of formula:

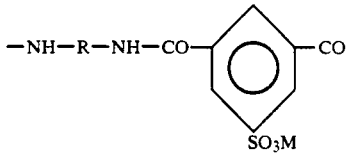

in which R and $R_2$ each represent a divalent aromatic radical, $R_1$ a trivalent aromatic radical and M an alkali metal or alkaline earth metal, (A) units representing 80 to 99 % of the whole of the units, (B) units 1 to 5% of the whole of the units and (C) units 0 to 20% of the whole of the units, and in that they have:

a polydispersion index I≦2.2 a breaking tenacity≧45 cN/tex a Young's modulus≧3.8 GPa an elongation≦25% a colour defined by the luminance Y>25%, the degree of whiteness DW<30, and the yellow index YI>170.

2. Threads, filaments and fibres according to claim 1, characterized in that they have a light stability quantified by a retention of breaking tenacity>50%, of work to breaking≧18% and of elongation≧35%.

3. Threads, filaments and fibres according to claim 2, characterized in that they have a retention of tenacity>52%, of work to breaking>20% and of elongation≧38%.

4. Threads, filaments and fibres according to claim 1, characterized in that they have a thermal stability defined by the degradation kinetics corresponding to a loss of weight as a function of the time≦3% per hour.

5. Threads, filaments and fibres according to claim 4, characterized in that they have degradation kinetics≦2% per hour.

6. Threads, filaments and fibres according to claim 1, characterized in that the breaking tenacity is≧55 cN/tex.

7. Threads, filaments and fibres according to claim 1, characterized in that the Young's modulus is≧5 GPa.

8. Threads, filaments and fibres according to claim 1, characterized in that the luminance is≧30%.

9. Threads, filaments and fibres according to claim 1, characterized in that the degree of whiteness is<28.

10. Threads, filaments and fibres according to claim 1, characterized in that the yellow index is>190.

11. Threads, filaments and fibres according to claim 1, characterized in that R is a radical of formula

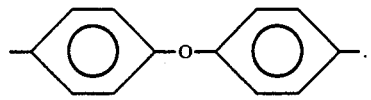

12. Threads, filaments and fibres according to claim 1, characterized in that $R_1$ is a radical of formula

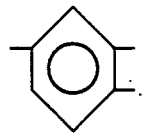

13. Threads, filaments and fibres according to claim 1, characterized in that $R_2$ is a radical of formula

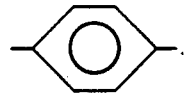

* * * * *